US007793740B2

(12) United States Patent
Thomson et al.

(10) Patent No.: US 7,793,740 B2
(45) Date of Patent: Sep. 14, 2010

(54) RIDE CONTROL FOR MOTOR GRADERS

(75) Inventors: Norval P. Thomson, Dunlap, IL (US); Steven A. Daniel, East Peoria, IL (US)

(73) Assignee: Caterpillar Inc, Peoria, IL (US)

( * ) Notice: Subject to any disclaimer, the term of this patent is extended or adjusted under 35 U.S.C. 154(b) by 60 days.

(21) Appl. No.: 12/262,310

(22) Filed: Oct. 31, 2008

(65) Prior Publication Data

US 2010/0108336 A1 May 6, 2010

(51) Int. Cl.
*E02F 3/76* (2006.01)
*F15B 13/08* (2006.01)

(52) U.S. Cl. ..... 172/795; 91/446

(58) Field of Classification Search ..... 172/2–11, 172/795–799.5; 91/444, 448, 446, 454; 60/452, 60/413, 420, 468; 180/333
See application file for complete search history.

(56) References Cited

U.S. PATENT DOCUMENTS 4,186,814 A 2/1980 Hart
5,116,188 A 5/1992 Kurohashi et al.
5,520,499 A 5/1996 Ufheil et al.
5,733,095 A 3/1998 Palmer et al.
5,890,870 A 4/1999 Berger et al.
5,897,287 A 4/1999 Berger et al.
6,260,355 B1 7/2001 Rausch et al.
6,357,230 B1 3/2002 A'Hearn et al.
6,634,653 B2 10/2003 Chatterjea
6,938,413 B2 9/2005 Harnischfeger
7,165,395 B2 1/2007 Anderson et al.
7,194,856 B2 3/2007 Ma et al.
7,204,185 B2 * 4/2007 Ma et al. ..... 91/446
7,415,822 B1 * 8/2008 Harber et al. ..... 60/452
7,614,335 B2 * 11/2009 Gradea ..... 91/444
7,614,336 B2 * 11/2009 VerKuilen et al. ..... 91/446

* cited by examiner

*Primary Examiner*—Robert E Pezzuto
(74) *Attorney, Agent, or Firm*—Leydig, Voit & Mayer

(57) ABSTRACT

A ride control arrangement for a machine having a frame, a ripper, a hydraulic actuator operative to move the ripper includes at least one accumulator assembly, and a valve mechanism operatively disposed between the accumulator assembly and the hydraulic actuator to either block or allow fluid communication between the hydraulic actuator and the accumulator assembly. A ride control arrangement for a motor grader with an implement operated by a hydraulic actuator similarly includes at least one accumulator assembly selectively fluidly connected to the hydraulic actuator by way of a valve mechanism.

14 Claims, 4 Drawing Sheets

RIDE CONTROL FOR MOTOR GRADERS

TECHNICAL FIELD

This patent disclosure relates generally to motor graders, and, more particularly to a ride control arrangement for motor graders.

BACKGROUND

Machines that include a weighted front-end attachment, such as a wheel loader including a loaded bucket, may bounce or lope as a result of the moment created by the load as the machine encounters rough terrain or other obstacles. Bounce typically occurs at one or more given speeds based upon the machine, the tires, and the attachments to the machine. In order to help reduce or eliminate this bounce, an accumulator may be selectively connected to the lift actuators coupled to the loaded attachment. With the accumulator connected to the loaded end of the lift actuators, pressure fluctuations in the actuators are absorbed, thus offsetting the moment created by the supported load. One such arrangement is disclosed in U.S. Pat. No. 5,733,095, which is likewise assigned to the assignee of this disclosure.

Motor graders typically include an elongated frame assembly with at least two sets of wheels that are widely spaced from one another and a blade assembly disposed between the sets of wheels. Variations in motor grader designs include, for example, machines having two closely disposed pairs of rear wheels from which a front pair of wheels is spaced, and machines that have articulated front and rear frame assemblies. Motor graders may additionally include a ripper coupled to the rear of the machine. Inasmuch as motor graders generally do not haul cantilevered loads, such bounce does not typically develop in the same manner as a wheel loader, for example. Such bounce can develop as a result of the elongated structure and widely spaced wheelbase of the motor grader and tire sidewall flexing. Accordingly, it is desirable to provide for a ride control arrangement that minimizes such bounce.

SUMMARY

The disclosure describes, in one aspect, a ride control system adapted for use on a motor grader having a frame with at least one implement coupled thereto and a hydraulic arrangement. The hydraulic arrangement includes at least one hydraulic actuator for movement of the implement, a directional control valve, a reservoir, and a source of pressurized fluid. The actuator includes first and second ports. The directional control valve is fluidly coupled to the actuator and the reservoir. The actuator is operative to raise and lower the implement relative to the frame in response to pressurized fluid being selectively directed to and from the respective ports thereof from the directional control valve. The ride control system comprises at least one accumulator assembly, a valve mechanism, a ride control input device, and a controller. The accumulator assembly is adapted to be connected to the first port of the actuator. The valve mechanism is adapted to be operatively disposed between the accumulator assembly and the first port of the actuator, and is moveable between a first position in which communication is blocked between the first port of the actuator and the accumulator assembly, and a second position in which open communication is permitted between the first port of the actuator and the accumulator assembly. The ride control input device is adapted to produce a ride control signal. The controller is connected to the valve mechanism and is adapted to receive the ride control signal. The controller is selectively operative to move the valve mechanism from its first position to its second position in response to the ride control signal wherein open communication is permitted between the first port of the actuator and the accumulator.

The disclosure describes, in another aspect, a machine comprising a frame supported by a plurality of wheels. First and second pairs of rear wheels are rotatably coupled to the frame at opposed first and second sides, respectively. At least one front wheel is also rotatably coupled to the frame, spaced from the first and second pairs of rear wheels. An implement is coupled to the frame. The machine further includes a reservoir configured to hold a supply of fluid, a source of pressurized fluid, a directional control valve, and at least one hydraulic actuator coupled to the frame and the implement. The actuator has first and second ports. The directional control valve is fluidly coupled to the actuator and the reservoir. The actuator is operative to raise and lower the implement relative to the frame in response to pressurized fluid being selectively directed to and from the respective ports of the actuator from the directional control valve. At least one accumulator assembly selectively connected to the first port of the actuator by a valve mechanism operatively disposed between the accumulator assembly and the first port of the actuator. The valve mechanism being selectively moveable between a first position in which communication is blocked between the first port of the actuator and the accumulator assembly, and a second position in which open communication is permitted between the first port of the actuator and the accumulator assembly. A ride control input device of the machine is adapted to produce a ride control signal. A controller is connected to the valve mechanism and adapted to receive the ride control signal and selectively move the valve mechanism from its first position to its second position in response to the ride control signal.

The disclosure describes, in another aspect, a method of controlling a machine on a terrain. The machine comprises a frame supported by a plurality of wheels. First and second pairs of rear wheels are rotatably coupled to the frame at opposed first and second sides, respectively. At least one front wheel is also rotatably coupled to the frame, spaced from the first and second pairs of rear wheels. An implement is coupled to the frame. The machine further includes a reservoir configured to hold a supply of fluid, a source of pressurized fluid, a directional control valve, and at least one hydraulic actuator coupled to the frame and the implement. The actuator has first and second ports. The directional control valve is fluidly coupled to the actuator and the reservoir. The actuator is operative to raise and lower the implement relative to the frame in response to pressurized fluid being selectively directed to and from the respective ports of the actuator from the directional control valve. The method comprising the steps of providing a controller, providing at least one accumulator assembly selectively connected to the first port of the actuator, providing a valve mechanism operatively disposed between the accumulator assembly and the first port of the actuator, the valve mechanism being selectively moveable between a first position in which communication is blocked between the first port of the actuator and the accumulator assembly and a second position in which open communication is permitted between the first port of the actuator and the accumulator assembly, causing a ride control input device to produce a ride control signal, the controller receiving the ride control input signal, selectively operating the controller to move the valve mechanism from the first position to the second position in response to the ride control signal, and providing open communication between the first port of the actuator and the accumulator assembly.

BRIEF DESCRIPTION OF THE DRAWING(S)

DETAILED DESCRIPTION

Figure 1:
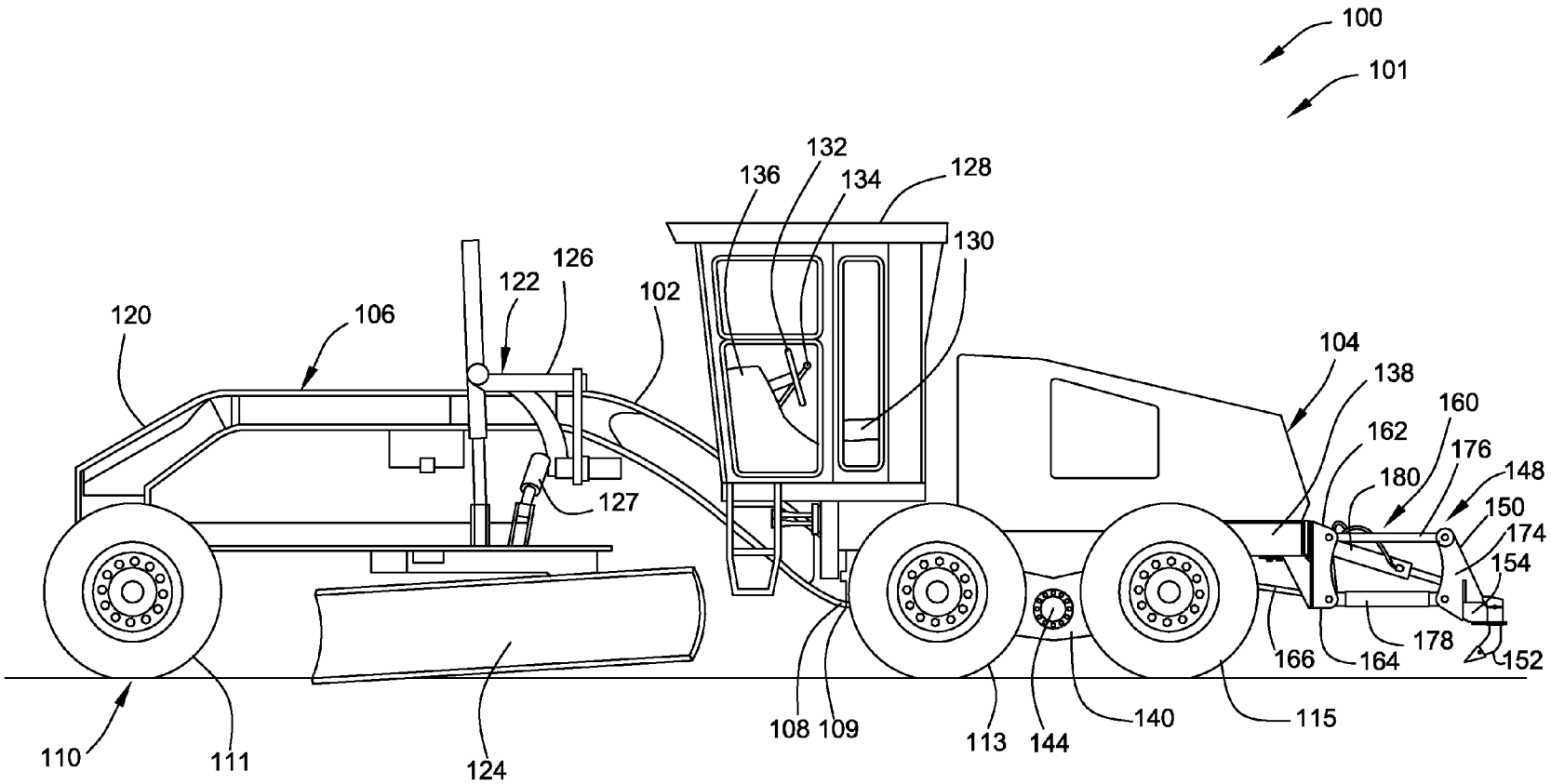
FIG. 1 is a side elevational view of a motor grader according to aspects of the disclosure.

This disclosure relates to a ride control arrangement for a machine 100 such as a motor grader 101 illustrated in FIG. 1. While the arrangement is illustrated in connection with a motor grader 101, the arrangement disclosed herein has universal applicability in various other types of machines 100 as well. The term "machine" may refer to any machine that performs some type of operation associated with an industry such as mining, construction, farming, transportation, or any other industry known in the art. For example, the machine may be an earth-moving machine, such as a tractor, wheel loader, excavator, dump truck, backhoe, motor grader, material handler or the like. Moreover, one or more implements may be connected to the machine 100. Such implements may be utilized for a variety of tasks, including, for example, brushing, compacting, grading, lifting, loading, plowing, ripping, and include, for example, augers, blades, breakers/hammers, brushes, buckets, compactors, cutters, forked lifting devices, grader bits and end bits, grapples, moldboards, rippers, scarifiers, shears, snow plows, snow wings, and others.

The motor grader 101 includes a mainframe 102. Although the mainframe 102 may be a single structure, in the illustrated embodiment, the mainframe 102 includes a rear frame portion 104 and a front frame portion 106. The rear and front frame portions 104, 106 may optionally be articulated at an articulated joint 108, which includes a hinge 109. The mainframe 102 is supported on a plurality of ground engaging members 110. In the illustrated embodiment, the ground engaging members 110 include a pair of front wheels 111, which are spaced from a plurality of rear wheels 113, 114, 115, 116, which are disposed pairs along opposite sides of the rear frame portion 104. It will be appreciated, however, that the ground engaging members 110 may include alternate arrangements, such as, for example, a pair of front wheels 111 and a single pair of rear wheels, or the rear wheels 113, 114, 115, 116 may alternately be track assemblies, as are known in the art.

The front frame portion 106 includes a front frame section 120 supported between the hinge 109 and forward ground engaging members 110, here, the illustrated pair of front wheels 111. A blade assembly 122 is mounted along the front frame section 120 and may be utilized for grading. The blade assembly 122 includes a blade 124 and a linkage assembly 126 that may include a hydraulic actuator 127 that allows the blade 124 to be moved to a variety of different positions relative to the motor grader 101.

An operator cab 128 may be supported along the front frame section 120. The cab 128 may include, for example, a seat 130, a steering mechanism 132, a speed-throttle or control lever 134, and a console 136. An operator occupying the cab 128 can control the various functions and motion of the motor grader 101, for example, by using the steering mechanism 132 to set a direction of travel for the motor grader 101 or by using the control lever 134 to set the travel speed of the machine. As can be appreciated, the representations of the various control mechanisms presented herein are generic and are meant to encompass all possible mechanisms or devices used to convey an operator's commands to a machine, including, for example, so-called joystick operation. While an operator cab 128 is shown in the illustrated embodiments, the inclusion of such a cab and associated seat, control mechanisms and console are optional in that the machine could alternately be autonomous, that is, the machine may be controlled by a control system that does not require operation by an on-board human operator.

The rear frame portion 104 includes a rear frame section 138 that is supported on the plurality of ground engaging members 110 along either side of the machine 100. In the illustrated embodiment, the ground engaging members 110 supporting the rear frame section 138 include two pairs of rear wheels 113, 115 and 114, 116. Although the ground engaging members 110 may alternately be coupled directly to the rear frame portion 104, in the illustrated embodiment, the pairs of rear wheels 113, 115, 114, 116 are rotatably mounted on tandem supports 140 that are themselves pivotably mounted along either side of the rear frame section 138 at pivot shafts 144. Thus, each of the rear wheels 113, 114, 115, 116 rotates and the tandem supports 140 pivot about respective axes. It will be understood by those of skill in the art that the ground engaging members 110 may include alternate or additional structure, such as, for example, belts (not shown) disposed about the pairs of rear wheels 113, 115, 114, 116.

For the purposes of this disclosure, the terms rear and front frame portions 104, 106 as used herein will likewise be utilized to refer generally to the forward and rearward portions of the mainframe 102 in embodiments wherein the mainframe 102 is not articulated and does not include separate rear and front frame portions 104, 106. Similarly, the terms rear and front frame sections 138, 120 as used herein will likewise be utilized to refer generally to the forward and rearward sections of the mainframe 102 in embodiments wherein the mainframe 102 is not articulated and does not include separate rear and front frame sections 138, 120.

The machine 100 may additionally include ripper assembly 148, which includes a ripper 150, which is mounted to the rear frame section 138 by an appropriate structure. The illustrated ripper 150 includes a plurality of fingers 152 that extend from a crossbeam 154. In this way, the fingers 152 may tear into relatively hard terrain in order to prepare the terrain to be moved by the blade assembly 122. The ripper 150 may be coupled to the rear frame section 138 of the rear frame portion 104 by any appropriate mounting arrangement. In the illustrated embodiment, the ripper 150 is coupled to the rear frame section 138 by a selectively operable arm assembly 160 and a mounting assembly 162. The mounting assembly 162 includes a mounting bracket 164 that mounts directly to the rear frame section 138 and that is further supported at its lower edge by a pair of supports 166, which are coupled to the mounting bracket 164 at one end 167, and to the rear frame section 138 at the other end 168.

The arm assembly 160 couples the ripper 150 to the mounting assembly 162 and permits the ripper 150 to be lowered to a terrain engaging position, or raised to an unengaged position when its use is not desired. While the arm assembly 160 may be of any appropriate design, in the illustrated embodiment, the arm assembly 160 is of a parallelogram arrangement that includes a pair of parallelograms 170, 172 extending generally in spaced, parallel planes. More specifically, the mounting bracket 164 itself forms a first side of the parallelogram, while a pair of arms 174 extending from the crossbeam 154 form the second, opposite side of the parallelogram. A first pair of links 176 extending between the upper end of the mounting bracket 164 and the upper ends of the arms 174 forms the upper side of the parallelogram. the lower side of the parallelogram is formed by a second pair of links 178 extending parallel to the first pair of links 176, but extending between the lower end of the mounting bracket 164 and the lower ends of the arms 174. In order to further stabilize the arm assembly 160 and further facilitate coordinated movement by the pair of parallelograms 170, 172, the second pair of links 178 is joined by a cross-brace 179 in the illustrated embodiment.

Figure 2:
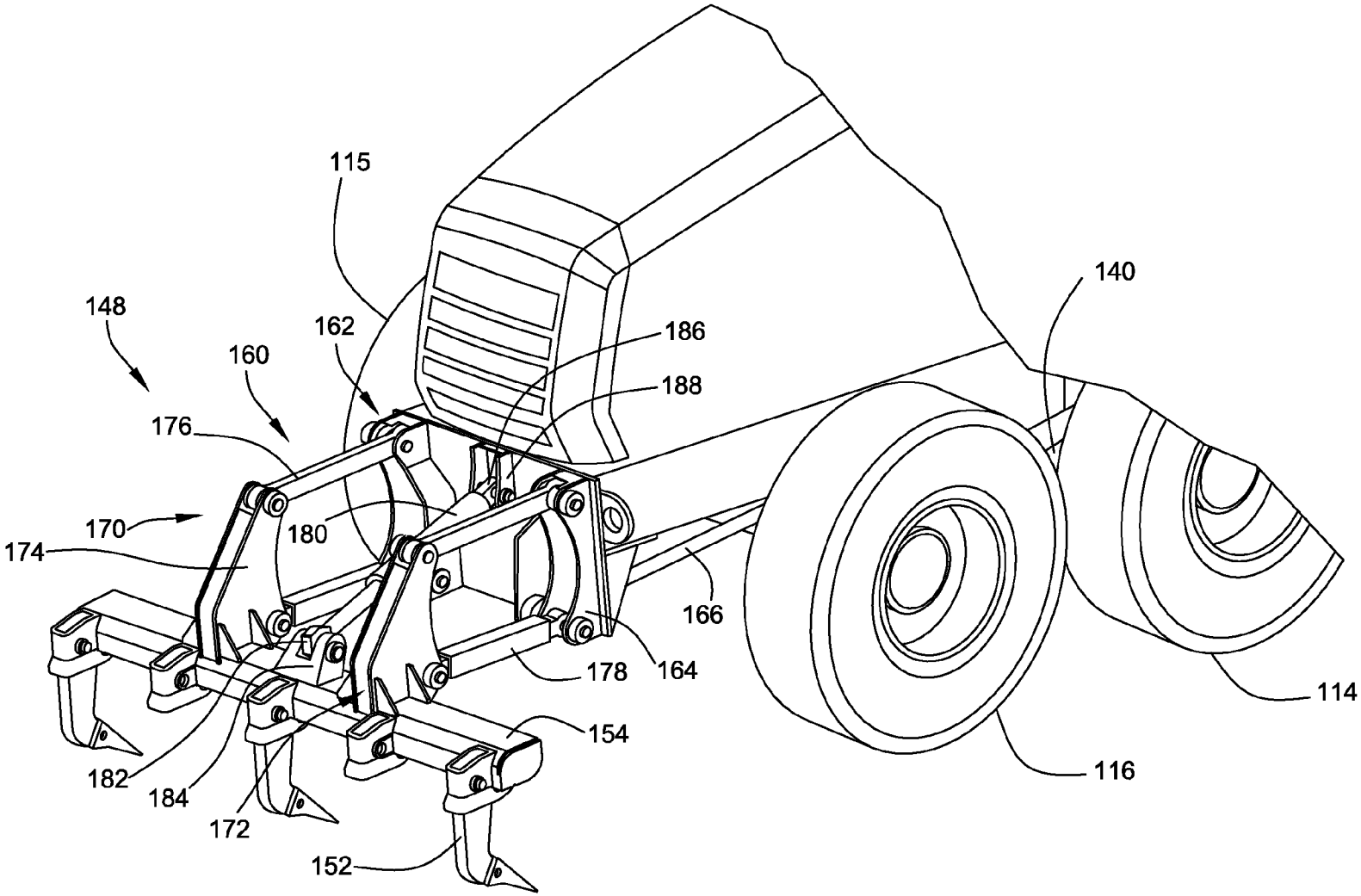
FIG. 2 is an enlarged, fragmentary, isometric view of the rear of the motor grader of FIG. 1.

The arm assembly 160 further includes at least one hydraulic actuator 180, which may be selectively retracted or extended to raise and lower the ripper 150. As may best be seen in FIG. 2, the actuator 180 extends between the ripper 150 and the rear frame section 138. More specifically, in the illustrated embodiment, the rod end 182 of the actuator 180 is coupled to an ear 184 on the cross-brace 154 of the ripper 150, and the cylinder end 186 of the actuator 180 is coupled to an ear 188 on the mounting assembly 162 secured to the rear frame section 138. In this way, the ripper 150 may be raised or lowered as a result of the actuation of the actuator 180, as may best be seen in FIGS. 3-5.

Figure 6:
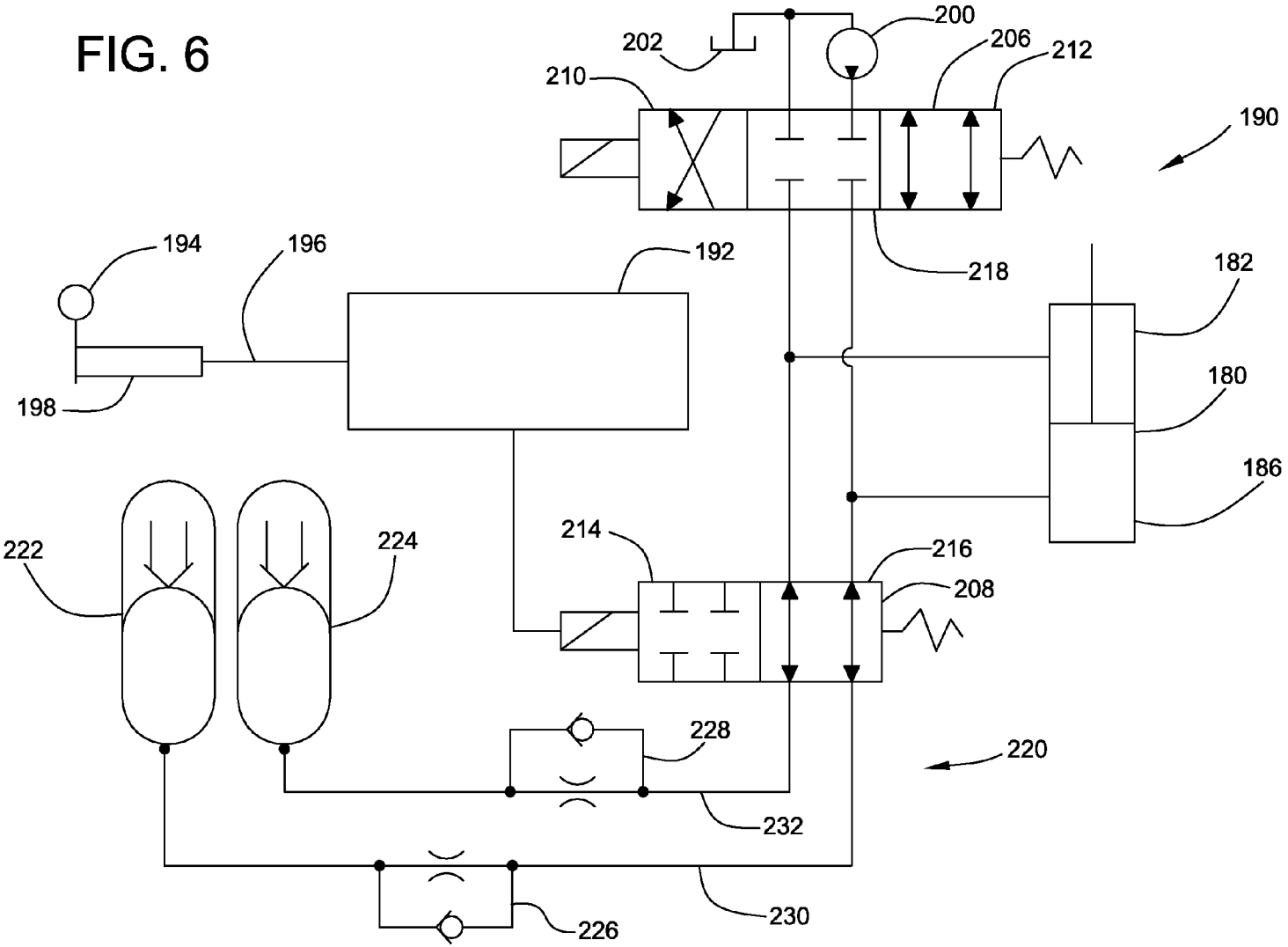
FIG. 6 is a schematic diagram of the hydraulic system of the motor grader of FIGS. 1-5 incorporating a ride control arrangement according to the disclosure.

A schematic of a hydraulic arrangement 190 including electrical controls for retraction or extension of the actuator 180 is illustrated in FIG. 6. The arrangement is shown in a simplified form merely for the purposes of illustration. As can be appreciated, hydraulic components and connections to drive additional or optional components are not shown for the sake of simplicity. Additional hydraulic components and connections may be provided in alternate hydrostatically driven machines to perform operations such as, by way of example only, lifting and/or tilting of attached implements, such as the blade 124 (not shown). Further, while a relatively basic arrangement is illustrated, it will be appreciated by those of skill in the art that more complex or alternate ride control arrangements could be utilized within the spirit and scope of this disclosure. Moreover, the ride control arrangement as will be described herein may be applied to alternate or additional implements on the illustrated motor grader 101, such as, for example, the blade 124 or snow plow(s), scarifiers, and the like. It will be appreciated that, although all such possible implements are not shown in the figures, similar arrangements could be provided to yield ride control based upon the movement of such alternate or additional implements.

As shown in FIG. 6, an electronic controller 192 may be connected to the machine 100 and arranged to receive information from various sensors and controls on the machine 100, process that information, and issue commands to various components within the hydraulic arrangement 190 during operation. Connections pertinent to the present description are shown but, as can be appreciated, a great number of other connections may be present relative to the controller 192. In this embodiment, the controller 192 is connected to a control input 194 (such as the control lever 134) via a control signal line 196. The control input 194, shown schematically, may be, for example, one or more levers or switches moveable by the operator of the machine 100 used to control an implement or set the ride control for the machine 100, and may generate any appropriate instruction to be provided to the controller 192. The position of the control input 194 may be translated to a control signal through a sensor 198 associated with the control input 194. The control signal is relayed to the controller 192 and may be used to yield a desired operation of the machine 100 or an associated implement.

Turning to the general operation of the hydraulic system 190 as illustrated in the diagram of FIG. 6, a hydraulic pump 200 is operated by a prime mover, such as, an engine (not illustrated) of the machine 100. Hydraulic fluid is discharged from and supplied to the hydraulic pump 200 from a vented reservoir or drain 202. While a fixed displacement, unidirectional pump 200 is illustrated, alternate arrangements, such as a variable displacement pump, a bidirectional pump, or a pair of pumps may be provided. Inasmuch as the details of the operation of the pump 200 are not relevant to this disclosure, such details are not illustrated in the figures. The pump 200 may be operated in any appropriate manner.

The controller 192 provides instructions to a directional control valve 206 and a valve mechanism 208, here in the forms of a three-position, two-way valve 206, and a two-position, two-way valve 208, respectively. As will be apparent below, in a working mode of the directional control valve 206, that is, when the directional control valve 206 is disposed in the first position 210 or the third position 212, the valve mechanism 208 is disposed in the first position 214 such that flow is blocked through the valve mechanism 208. Conversely, when the valve mechanism 208 is operational to provide ride control during travel of the machine 100, that is, when the valve mechanism 208 is disposed in the second position 216, the directional control valve 206 is disposed in the second position 218 such that flow is blocked through the directional control valve 206.

Figure 3:
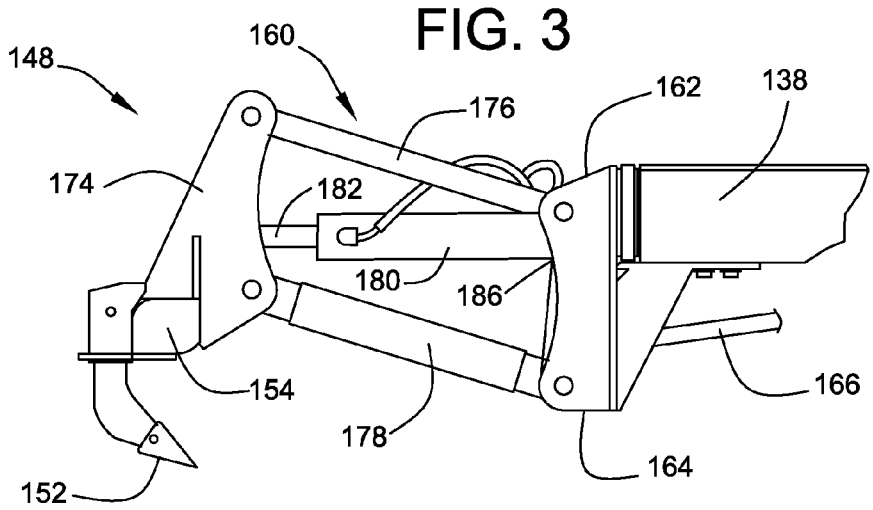
FIG. 3-5 are enlarged, fragmentary, side elevational views of the ripper assembly of FIGS. 1 and 2, showing the ripper in various positions.
Figure 4:
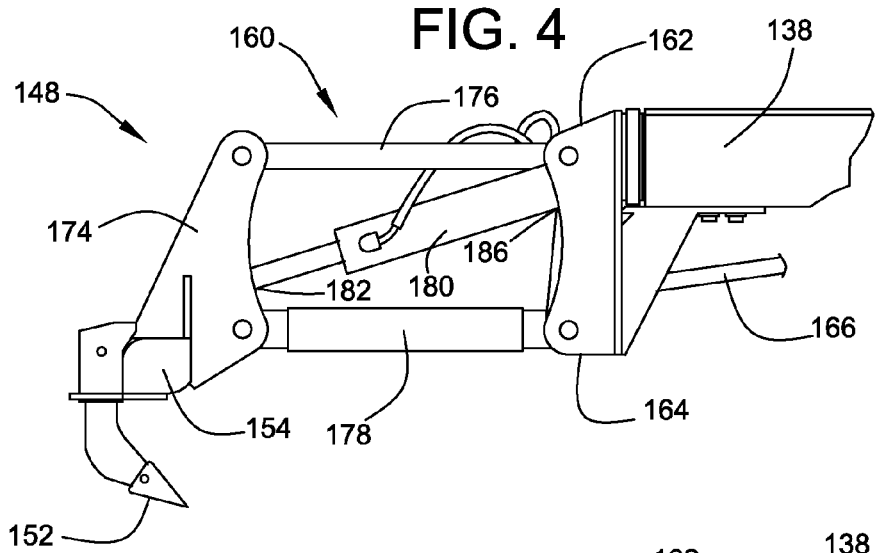
Figure 5:
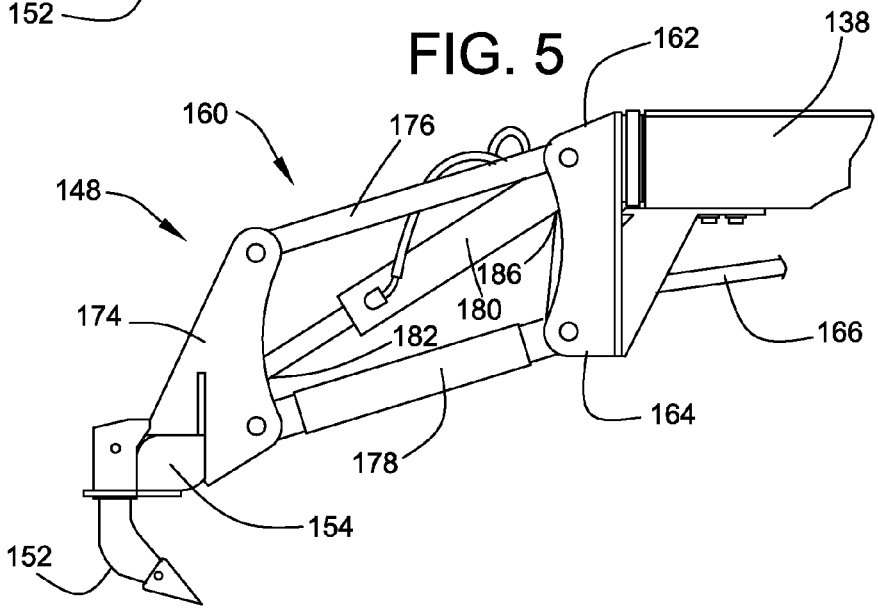

More specifically, during normal operation, the directional control valve 206 may be utilized to raise and lower the ripper 148, as no ride control is necessary. In this way, when the directional control valve 206 is in the first position 210, a port 185 to a chamber 187 in the cylinder end 186 of the actuator 180 is fluidly connected to the reservoir 202, while the pump 200 provides flow to a port 181 to a chamber 183 in the piston end 182 of the actuator 180 to retract the arm assembly 162 and raise the ripper 148, as shown in FIG. 3. Conversely, when the directional control valve 206 is in the third position 212, the piston end 182 of the actuator 180 is fluidly connected to the reservoir 202, while the pump 200 provides flow to cylinder end 186 of the actuator 180 to extend the arm assembly 162 and lower the ripper 148, as shown in FIG. 5.

As may be seen in the simplified hydraulic arrangement 190 illustrated, during non-working travel, the directional control valve 206 may be placed in the second position 218 with the actuator 180 disconnected from the pump 200 and reservoir 202 such that the actuator 180, and, therefore, the associated tool, here, the ripper 148, is maintained in a given position. In order to suppress or minimize bounce or loping of the machine 100 during travel, the motor grader 101 may be provided with a ride control arrangement 220. More particularly, the hydraulic arrangement 190 for raising and lowering the ripper 150 may be provided with one or more accumulators 222, 224 that are selectively connectible with the actuator 180. When the valve mechanism 208 is disposed in the second position 216, as shown in FIG. 6, accumulator 222 is fluidly coupled to the cylinder end 186 of the actuator 180 such that pressure may be equalized between the two. Similarly, accumulator 224 is fluidly coupled to the piston end 182 of the actuator 180 such that pressure may be equalized between the two.

In the illustrated embodiment, choke and check valve arrangements 226, 228 are provided in conduits 230, 232 between the accumulator 222 and the cylinder end 186 of the accumulator 180, and between the accumulator 224 and the rod end 182 of the accumulator 180, respectively. The choke and check valve arrangements 226, 228 operate in a conventional manner to permit free flow of fluid in the conduit 230, 232 from the associated accumulator 222, 224 to the actuator 180, and to choke flow from the piston end 182 and/or cylinder end 186 through the associated conduit 232, 230 to the respective accumulator 224, 222, which may minimize possible sudden jarring as the operator switches to ride control mode.

Although two accumulators 222, 222 are provided in the illustrated embodiment, an alternate arrangement may include, for example, a single accumulator wherein the loaded end of the actuator 180 is selectively connectible with the accumulator. Similarly, the check valve and choke arrangements may be eliminated, and/or the flow arrangement supplemented with additional flow controls or the like, including, by way of example only, bleeder valves or the like. Moreover, alternate valve and connection arrangements may be provided within the spirit and scope of this disclosure.

INDUSTRIAL APPLICABILITY

The present disclosure is applicable to machines 100 including a ripper arrangement 148 and to motor graders including an implement, such as, for example, a ripper, blade, scarifier, or snowplow.

During normal operation, the operator has normal control of the implement. When it is desirable to travel for a distance, however, the operator may activate the ride control by way of switch 194 to fluidly connect one or more accumulators 222, 224 with the actuator(s) 180 to provide an arrangement wherein the normal movements of the implement are dampened. In this way, the ride control arrangement 190 may minimize bounce or loping of the machine 100 as it travels across a terrain.

We claim:

1. A machine comprising a frame, a ripper coupled to the frame, a hydraulic arrangement including at least one hydraulic actuator coupled to the frame and the ripper, the hydraulic actuator being operative to move the ripper, at least one accumulator assembly, a valve mechanism operatively disposed between the accumulator assembly and the hydraulic actuator, the valve mechanism being operative to either block or allow fluid communication between the hydraulic actuator and the accumulator assembly, a controller connected to the valve mechanism, the controller being selectively operative to cause the valve mechanism to either block or allow communication between the hydraulic actuator and the accumulator assembly, a ride control input device adapted to produce a ride control signal, the controller being adapted to receive the ride control signal and cause the valve mechanism to either block or allow communication between the hydraulic actuator and the accumulator assembly.

2. A machine comprising a frame, a ripper coupled to the frame, a hydraulic arrangement including at least one hydraulic actuator coupled to the frame and the ripper, a directional control valve, a reservoir, and a source of pressurized fluid, the directional control valve being fluidly coupled to the hydraulic actuator and the reservoir, the hydraulic actuator being operative to raise and lower the ripper relative to the frame in response to pressurized fluid being selectively directed to and from the hydraulic actuator from the directional control valve, at least one accumulator assembly, a valve mechanism operatively disposed between the accumulator assembly and the hydraulic actuator, the valve mechanism being operative to either block or allow fluid communication between the hydraulic actuator and the accumulator assembly.

3. A machine comprising a frame, a ripper coupled to the frame, a hydraulic arrangement including at least one hydraulic actuator coupled to the frame and the ripper, a source of pressurized fluid, wherein the hydraulic actuator includes first and second chambers, and first and second ports opening into the first and second chambers, respectively, the first and second chambers selectively filled with and drained of the pressurized fluid to move the ripper, at least one accumulator assembly, and a valve mechanism selectively operatively disposed between the accumulator assembly and the first port of the hydraulic actuator, the valve mechanism being moveable between a first position in which communication is blocked between the first port of the hydraulic actuator and the accumulator assembly and a second position in which open communication is permitted between the first port of the hydraulic actuator and the accumulator assembly, pressure being substantially equalized between the first chamber and the accumulator assembly when the valve mechanism is disposed in the second position.

4. The machine of claim 3 further including a directional control valve, a reservoir, a source of pressurized fluid, a ride control input device adapted to produce a ride control signal, and a controller connected to the valve mechanism, the controller being adapted to receive the ride control signal and selectively operative to cause the valve mechanism to move between the first and second positions, the directional control valve being fluidly coupled to the hydraulic actuator and the reservoir, the hydraulic actuator being operative to raise and lower the ripper relative to the frame in response to pressurized fluid being selectively directed to and from the hydraulic actuator from the directional control valve.

5. A method of controlling a ride of a machine on a terrain, the machine having a frame, the method comprising the steps of:

coupling a ripper to the frame, coupling a hydraulic actuator to the frame and to the ripper, the hydraulic actuator being operative to move the ripper relative to the frame, selectively fluidly coupling at least one accumulator assembly to the hydraulic actuator, operatively disposing a valve mechanism between the accumulator assembly and the hydraulic actuator, causing a ride control input device to produce a ride control signal, providing the ride control signal to a controller, selectively operating the controller to cause the valve mechanism to either block or allow communication between the hydraulic actuator and the accumulator assembly.

6. A method of controlling a ride of a machine on a terrain, the machine having a frame, the method comprising the steps of:

coupling a ripper to the frame, coupling a hydraulic actuator to the frame and to the ripper, the hydraulic actuator being operative to move the ripper relative to the frame, selectively fluidly coupling at least one accumulator assembly to the hydraulic actuator, operatively disposing a valve mechanism between the accumulator assembly and the hydraulic actuator, producing a ride control signal, providing the ride control signal to a controller, selectively operating the controller to cause the valve mechanism to either block or allow communication between the hydraulic actuator and the accumulator assembly, and providing open communication between a port of the hydraulic actuator and the accumulator assembly.

7. A method of controlling a ride of a machine on a terrain, the machine having a frame, the method comprising the steps of:

coupling a ripper to the frame, coupling a hydraulic actuator to the frame and to the ripper, the hydraulic actuator being operative to move the ripper relative to the frame, selectively fluidly coupling at least one accumulator assembly to the hydraulic actuator, operatively disposing a valve mechanism between the accumulator assembly and a first port of the hydraulic actuator, the valve mechanism being selectively moveable between a first position in which communication is blocked between the first port of the hydraulic actuator and the accumulator assembly and a second position in which open communication is permitted between the first port of the hydraulic actuator and the accumulator assembly, and operating the valve mechanism to selectively block or allow fluid communication between the hydraulic actuator and the accumulator assembly.

8. A method of controlling a ride of a machine on a terrain, the machine having a frame, the method comprising the steps of:

coupling a ripper to the frame, coupling a hydraulic actuator to the frame and to the ripper, the hydraulic actuator being operative to move the ripper relative to the frame, selectively fluidly coupling at least one accumulator assembly to the hydraulic actuator, operatively disposing a valve mechanism between the accumulator assembly and the hydraulic actuator, and operating the valve mechanism to selectively block or provide open communication between a chamber of the hydraulic actuator and the accumulator assembly to balance the pressures of the fluid in the chamber and the accumulator assembly.

9. A motor grader comprising:

a frame, opposed first and second sides, a first pair of rear wheels rotatably coupled to the frame along the first side, a second pair of rear wheels rotatably coupled to the frame along the second side, at least one front wheel rotatably coupled to the frame, the front wheel being spaced from the first and second pairs of rear wheels, at least one implement coupled to the frame, a source of pressurized fluid, a directional control valve, at least one hydraulic actuator coupled to the frame and the implement, the hydraulic actuator including first and second chambers and first and second ports in communication with the first and second chambers, the hydraulic actuator being operative to raise and lower the implement relative to the frame in response to pressurized fluid being selectively directed to and from the first and second ports of the hydraulic actuator from the directional control valve, an accumulator assembly selectively fluidly connected to the hydraulic actuator, and a valve mechanism operatively disposed between the accumulator assembly and the first port of the hydraulic actuator, the valve mechanism being selectively moveable between a first position in which communication is blocked between the first port of the hydraulic actuator and the accumulator assembly, and a second position in which open communication is permitted between the first port of the hydraulic actuator and the accumulator assembly.

10. The motor grader of claim 9 further including a ride control input device adapted to produce a ride control signal, and a controller connected to the valve mechanism and adapted to receive the ride control signal, the controller being selectively operative to move the valve mechanism from its first position to its second position in response to the ride control signal.

11. A motor grader comprising:

a frame, opposed first and second sides, a first pair of rear wheels rotatably coupled to the frame along the first side, a second pair of rear wheels rotatably coupled to the frame along the second side, at least one front wheel rotatably coupled to the frame, the front wheel being spaced from the first and second pairs of rear wheels, at least one implement coupled to the frame, at least one hydraulic actuator coupled to the frame and the implement, the hydraulic actuator being selectively operative to move the implement relative to the frame, an accumulator assembly selectively fluidly connected to the hydraulic actuator, a valve mechanism operatively disposed between the accumulator assembly and the hydraulic actuator, the valve mechanism being operative to either block or allow communication between the hydraulic actuator and the accumulator assembly, a ride control input device adapted to produce a ride control signal, and a controller connected to the valve mechanism and adapted to receive the ride control signal, the controller being selectively operative to move the valve mechanism to either block or allow communication between the hydraulic actuator and the accumulator assembly in response to the ride control signal.

12. A motor grader comprising:

a frame, opposed first and second sides, a first pair of rear wheels rotatably coupled to the frame along the first side, a second pair of rear wheels rotatably coupled to the frame along the second side, at least one front wheel rotatably coupled to the frame, the front wheel being spaced from the first and second pairs of rear wheels, at least one implement coupled to the frame, the implement including at least one of a scarifier, a ripper, a snowplow, and a snow wing, at least one hydraulic actuator coupled to the frame and the implement, the hydraulic actuator being selectively operative to move the implement relative to the frame, an accumulator assembly selectively fluidly connected to the hydraulic actuator, a valve mechanism operatively disposed between the accumulator assembly and the hydraulic actuator, the valve mechanism being operative to either block or allow communication between the hydraulic actuator and the accumulator assembly.

13. A motor grader comprising:

a frame, opposed first and second sides, a first pair of rear wheels rotatably coupled to the frame along the first side, a second pair of rear wheels rotatably coupled to the frame along the second side, at least one front wheel rotatably coupled to the frame, the front wheel being spaced from the first and second pairs of rear wheels, at least a first and a second implement coupled to the frame, at least one first hydraulic actuator coupled to the frame and the first implement, the first hydraulic actuator being selectively operative to move the first implement relative to the frame, at least one second hydraulic actuator coupled to the frame and the second implement, the second hydraulic actuator being selectively operative to move the second implement relative to the frame, at least one accumulator assembly selectively fluidly connected to the first hydraulic actuator and to the second hydraulic actuator, and at least one valve operatively disposed between the at least one accumulator assembly and the first and second hydraulic actuators, the valve mechanism being operative to either block or allow communication between the hydraulic actuator and at least one of the accumulator assemblies.

14. The motor grader of claim 13 including at least a first accumulator assembly and a second accumulator assembly, the first accumulator assembly being selectively fluidly connected to the first hydraulic actuator, and the second accumulator assembly being selectively fluidly connected to the second hydraulic actuator.

* * * * *